US007431654B2

(12) United States Patent
Ochi

(10) Patent No.: US 7,431,654 B2
(45) Date of Patent: Oct. 7, 2008

(54) PLAY APPARATUS

(75) Inventor: Yasushi Ochi, Izumisano (JP)

(73) Assignee: BLD Oriental, Ltd, Izumisano-shi (JP)

( * ) Notice: Subject to any disclaimer, the term of this patent is extended or adjusted under 35 U.S.C. 154(b) by 565 days.

(21) Appl. No.: 10/906,776

(22) Filed: Mar. 7, 2005

(65) Prior Publication Data

US 2006/0199464 A1 Sep. 7, 2006

(51) Int. Cl.
*A63G 21/18* (2006.01)

(52) U.S. Cl. ..... 472/117; 446/167

(58) Field of Classification Search ..... 472/116–117, 472/128, 134, 137; 446/167
See application file for complete search history.

(56) References Cited

U.S. PATENT DOCUMENTS 5,478,281 A * 12/1995 Forton ..... 472/117
6,176,027 B1 1/2001 Blount
6,406,377 B1 * 6/2002 Demko ..... 472/117
6,413,165 B1 7/2002 Crandall et al.
6,582,315 B1 * 6/2003 Formanski ..... 472/117
2002/0082097 A1 * 6/2002 Henry et al. ..... 472/117

* cited by examiner

*Primary Examiner*—Robert E Pezzuto
*Assistant Examiner*—Alex F. R. P. Rada, II
(74) *Attorney, Agent, or Firm*—Westerman, Hattori, Daniels & Adrian, LLP.

(57) ABSTRACT

Play facility that can be safely played on by preschoolers, and that can be set up indoors. The play facility (1) includes hollow play structures (2) and (8) having a play surface on which a play participant can engage in play, the play surface being a vertical, oblique, or stair-shaped surface, with members (3), (9) constituting at least the play surface being made of a transparent material; liquid spouting units (20), (21) for spouting a pressurized liquid L against a surface on an inner side of the transparent member (3), (9), the liquid spouting units (20), (21) being disposed at an upper position within the hollow portion of the play structure (2), (8); and a liquid supply system (15) for pressurizing the liquid L collected in a bottom region inside the hollow portion of the play structure (2), (8) and supplying the pressurized liquid to the liquid spouting units (20), (21).

9 Claims, 7 Drawing Sheets

PLAY APPARATUS

BACKGROUND OF THE INVENTION

1. Technical Field

The present invention relates to play facilities for installation in children's areas in amusement parks, department stores, supermarkets, or the like.

2. Description of the Related Art

One conventionally known play facility, which can be set up in amusement parks or the like, is the so-called "water slide," wherein a slide having a sliding surface down which a play participant can slide is provided with a water-pumping system that lets water flow down the sliding surface of the slide, so that the play participant can slide down the sliding surface together with the flowing water. (Cf. Japanese Unexamined Pat. App. Pub. No. 2000-167254A.)

In such water slides, the frictional resistance between the play participant and the sliding surface is reduced when the play participant slides down a sliding surface on which water flows, so that the sliding speed of the play participant is accelerated, thus letting the play participant experience the excitement of speeding down the slide while being immersed in the flowing water.

Nevertheless, while conventional water slides demonstrate such effects, their downside is that their overall configuration is very bulky, and it is virtually impossible to install them in indoor children's areas of department stores, supermarkets, etc., and another problem with them is that they can be used only in summer.

Also, since the sliding speed can be very fast, they are suitable for children above a certain height, but not for preschoolers.

BRIEF SUMMARY OF THE INVENTION

In view of the above-described situation, it is an object of the present invention to provide a play facility that can be safely used by preschoolers and that can be set up indoors.

In order to achieve the above-noted objects of the present invention, a play facility in accordance with the present invention comprises: a hollow play structure having a play surface on which a play participant can engage in play, the play surface being a vertical surface, an oblique surface or a stair-shaped surface, and a member constituting at least the play surface being made of a transparent material; a liquid spouting means for spouting a pressurized liquid against a surface on an inner side of the transparent member, the liquid spouting means being disposed at an upper position within the hollow portion of the play structure; and a liquid supply means for pressurizing liquid collected in a bottom region inside the hollow portion of the play structure and supplying the pressurized liquid to the liquid spouting means.

With this play facility, first, a predetermined amount of liquid is supplied to and collected in the region at the bottom in the hollow portion of the play structure. Then, the collected liquid is pressurized by the liquid supply means and supplied to the liquid spouting means, which spouts the liquid against the inner surface of the transparent member constituting the play surface. The spouted liquid slows down along the inner surface of the transparent member, and it can be seen from the outside through the transparent member how the liquid flows down.

The play participant can engage in play on the play surface while viewing the river-like flow of the liquid through the transparent member, and can imagine to be playing in a stream or in a waterfall flowing over a cliff, without directly coming in contact with the liquid. Consequently, play is possible not only in summer, but throughout the year.

Moreover, the liquid flows inside the hollow portion of the play structure, so that there is no risk of the liquid leaking to the outside, and it is possible to set up the play facility in an indoor children's area or the like without taking any special measures against leakage.

The play structure may be configured such that the play surface is an oblique surface, and the play participant can slide down on the play surface. This configuration of the play structure corresponds to a slide, so that the play participant can experience a sensation akin to that on a waterslide in which the play participant slides down in a stream of water. This configuration can also be safely enjoyed by preschoolers.

The play structure can also be configured such that the play surface is a vertical surface or an oblique surface, and a plurality of protrusions are affixed on the play surface. The protrusions may resemble logs or small rocks, for example. If they are log-shaped, then they can be laid out to form a ladder, and if they are shaped like small rocks, then they may be laid out in an irregular arrangement.

Thus, the play participant can experience a sensation as if rock-climbing in a waterfall flowing along a cliff.

It is also possible to have a plurality of the liquid spouting means lined up at a predetermined spacing from an upper position to a lower position within the hollow portion of the play structure. Thus, a flow of liquid can be formed without interruption along the entire inner face of the transparent member, which is particularly effective in the case of the stair-shaped play surface.

The play facility may further comprise an illumination means for illuminating the inside of the hollow portion of the play structure, wherein light illuminating the inside of the hollow portion passes through the transparent member and is visible from outside. Thus, the illuminated liquid stream is accentuated by this illumination, which, together with the effect of the illumination, gives a playful air to the facility.

As explained in detail above, with the present invention, the play surface of the hollow play structure is made from a transparent member, and a pressurized liquid is spouted against the inner face of this transparent member, so that the play participant can engage in play on the play surface while viewing a liquid stream akin to the flow of a river or a waterfall through the transparent member. Also, without directly coming in contact with the liquid, the play participant can experience a sensation as if playing in a river stream or in a waterfall flowing over a cliff. Also, play is not limited to summer but possible throughout the year, and the play facility can be set up in an indoor children's area or the like.

Further, by lining up a plurality of the liquid spouting means from an upper position to a lower position at a predetermined spacing within the hollow portion of the play structure, a flow of liquid can be formed without interruption along the entire inner face of the transparent member. And by providing an illumination means for illuminating the inside of the hollow portion of the play structure, the illuminated liquid stream is accentuated by this illumination, which, together with the effect of the illumination, gives a playful air to the facility.

From the following detailed description in conjunction with the accompanying drawings, the foregoing and other objects, features, aspects and advantages of the present invention will become readily apparent to those skilled in the art.

DETAILED DESCRIPTION OF THE INVENTION

Figure 1:
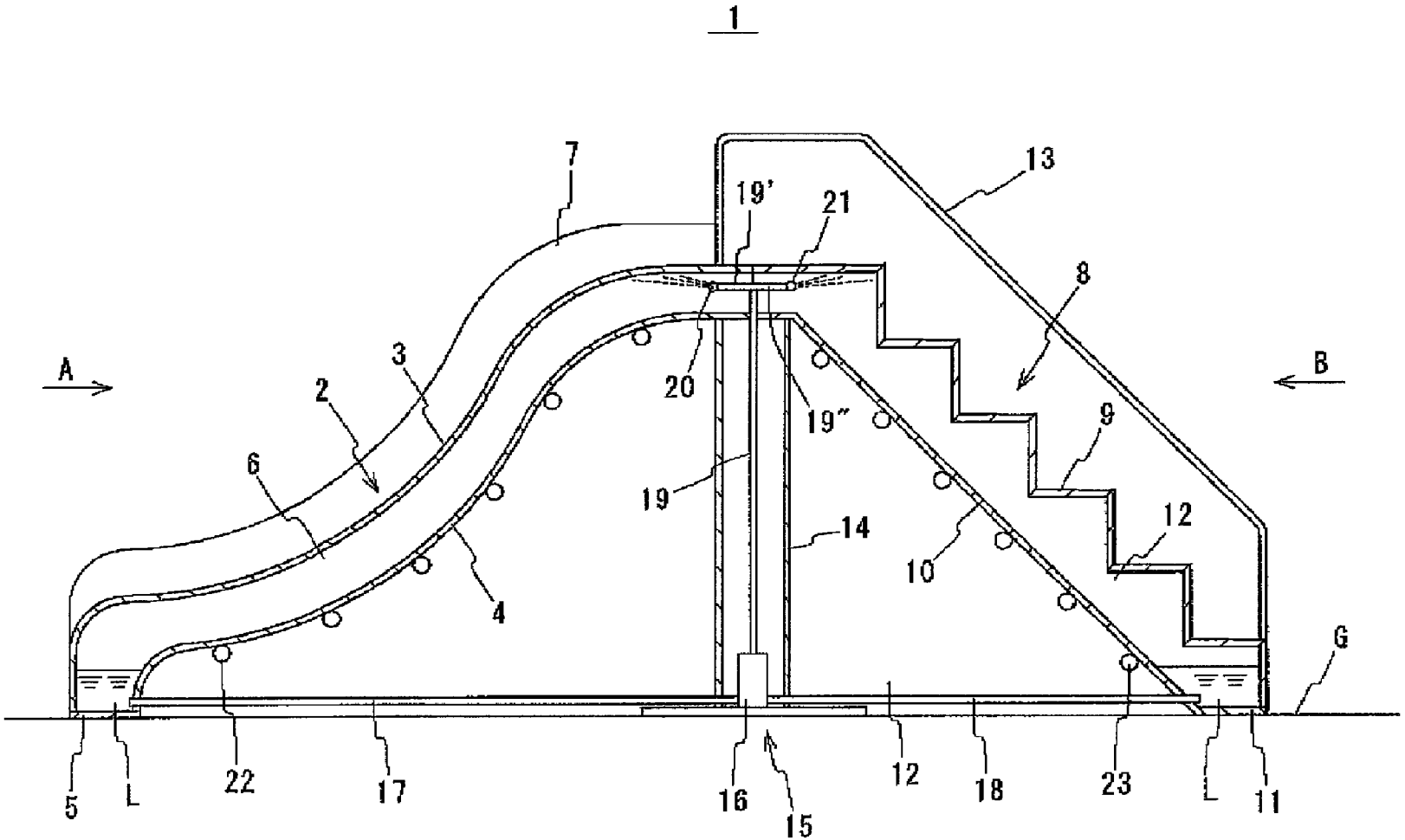
FIG. 1 is a is a lateral cross-sectional view of a play facility according to an embodiment of the present invention.
Figure 2:
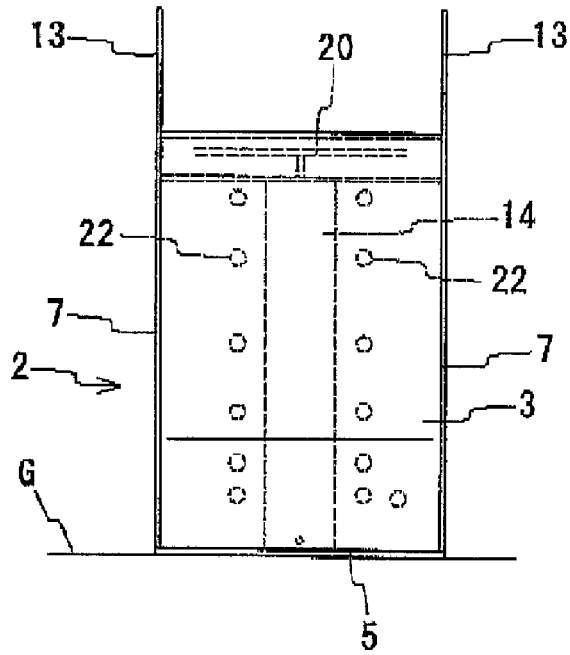
FIG. 2 is a front view of the play facility in FIG. 1, taken from the direction of arrow A.
Figure 3:
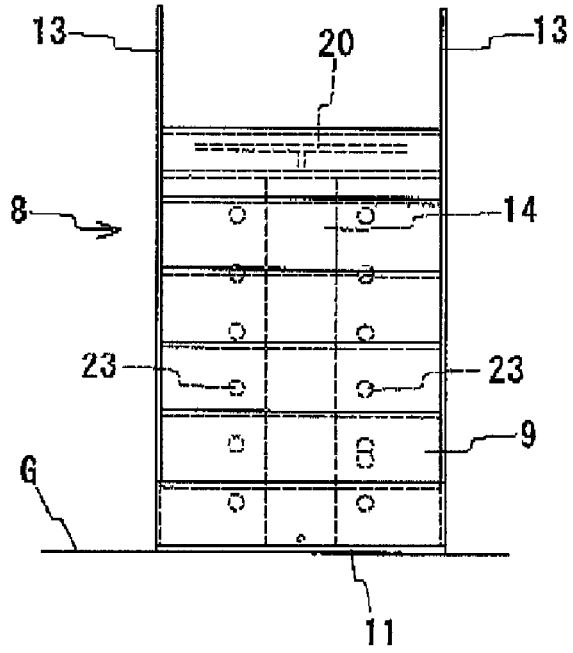
FIG. 3 is a rear view of the play facility in FIG. 1, taken from the direction of arrow B.

The following is a description of preferred embodiments of the present invention, with reference to the accompanying drawings. FIG. 1 is a lateral cross-sectional view of a play facility according to an embodiment of the present invention. FIG. 2 is a front view of the play facility in FIG. 1, taken from the direction of arrow A. FIG. 3 is a rear view of the play facility in FIG. 1, taken from the direction of arrow B.

As shown in FIG. 1, the play facility 1 of this example includes a first play structure 2, a second play structure 8, a liquid supplying system 15, liquid spouting nozzles 20 and 21, and illumination lamps 22 and 23.

The first play structure 2 is provided with an airtight hollow structure made of an upper oblique member 3 and a lower oblique member 4, a bottom member 5, and two side members 6. The upper oblique member 3 and the lower oblique member 4 are arranged one above the other at a predetermined spacing in vertical direction, and are both substantially S-shaped in their lateral cross section. The bottom member 5 is fixed to the lower ends of the upper oblique member 3 and the lower oblique member 4. The two side members 6 are fixed to the two lateral ends of the upper oblique member 3 and the lower oblique member 4, respectively. Side guards 7 are erected on either side of the upper perspective member 3.

The second play structure 8 is provided with an airtight hollow structure made of a stair-shaped upper member 9, a lower member 10, a bottom member 11, and two side members 12. The lower member 10 is arranged obliquely at a predetermined spacing below the upper member 9. The bottom member 11 is fixed to the lower ends of the upper member 9 and the lower member 10. The two side members 12 are fixed to the two lateral ends of the upper member 9 and the lower member 10, respectively. Also, handrails 13 are erected on either side of the upper member 9.

The first play structure 2 and the second play structure 8 are joined together at their upper portion such that their hollow portions are in communication, and this joint is supported by a hollow support pillar 14. The liquid spouting nozzle 20 is disposed near the upper end inside the hollow portion of the first play structure 2, and the liquid spouting nozzle 21 is disposed near the upper end inside the hollow portion of the second play structure 8. The lower ends of the first play structure 2 and the second play structure 8 are both in contact with the underlying ground G. Also, the upper oblique member 3, the lower oblique member 4, the bottom member 5, and side members 6 of the first play structure 2, as well as the upper member 9, the lower member 10, the bottom member 11, and the side members 12 of the second support structure 8 are all made of transparent members, such as acrylic plates.

The liquid supplying system 15 is made of a pump 16, water intake ducts 17 and 18, and a water supply duct 19. The pump 16 is provided at the bottom inside the hollow portion of the support pillar 14. Piercing the lower oblique member 4 of the first play structure 2, one end of the water intake duct 17 is connected to the region at the bottom inside the hollow portion of the first play structure 2, and piercing the support pillar 14, the other end of the water intake duct 17 is connected to pump 16. Similarly, piercing the lower member 10 of the second play structure 8, one end of the water intake duct 18 is connected to the region at the bottom inside the hollow portion of the second play structure 8, and piercing the support pillar 14, the other end of the water intake duct 18 is connected to pump 16. One end of the water supply duct 19, which is arranged inside the hollow portion of the support pillar 14, is connected to the pump 16, and the other end branches into two ducts, with one duct 19' being connected to the liquid spouting nozzle 20, and the other duct 19" being connected to the liquid spouting nozzle 21.

As shown in FIGS. 2 and 3, the liquid spouting nozzles 20 and 21 are made of tubes that are laid out in the sideways direction of the first play structure 2 and the second play structure 8, and spouting holes are drilled at predetermined spacing along the longitudinal direction of those tubes. The liquid is spouted from the spouting holes of the liquid spouting nozzle 20 toward the rear surface of the upper oblique member 3 and from the spouting holes of the liquid spouting nozzle 21 toward the rear surface of the upper member 9.

The illumination lamps 22 are attached to the lower side of the lower oblique member 4, and similarly, the illumination lamps 23 are attached to the lower side of the lower member 10. Power is supplied to the illumination lamps 22 and 23 from a power supply (not shown in the drawings), thus lighting the lamps.

With the play facility 1 according to this example configured as described above, a predetermined amount of liquid (for example water) L is supplied to and collected in the regions at the bottom in the hollow portion of the first play structure 2 and the second play structure 8.

Then, power is supplied to light the illumination lamps 22 and 23, and the pump 16 is driven. Thus, the liquid L held in the first play structure 2 and the second play structure 8 is sucked into the pump 16 through the water intake ducts 17 and 18, is pressurized by the pump 16, and supplied through the supply duct 19 to the liquid spouting nozzles 20 and 21.

The liquid L supplied to the liquid spouting nozzle 20 is spouted from the spouting holes against the rear surface of the upper oblique member 3, and the spouted liquid L runs downward along the rear surface of the upper oblique member 3, so that it can be seen from outside through the upper oblique member 3 how the liquid runs down the upper oblique member 3.

Similarly, the liquid L supplied to the liquid spouting nozzle 21 is spouted from the spouting holes against the rear surface of the upper member 9, and the spouted liquid L runs downward along the rear surface of the upper member 9, so that it can be seen from outside through the upper member 9 how the liquid runs down the upper member 9.

Moreover, by lighting the illumination lamps 22, the inside of the hollow portion of the first play structure 2 is illuminated through the lower oblique member 4, and the liquid running down the upper oblique member 3 is accentuated by this illumination, which, together with the effect of the illumination, gives a playful air to the facility.

Also in the second play structure 8, the inside of the hollow portion is illuminated through the lower member 10 by lighting the illumination lamps 23, and the liquid running down along the upper member 9 is accentuated by this illumination, which, together with the effect of the illumination, gives a playful air to the facility.

Having set up the playing environment in this manner, the play participant can enjoy the facility as follows:

First, the play participant walks up the stair-shaped upper member 9 of the second play structure 8, and having reached the top, sits down and slides down the upper oblique member 3 of the first play structure 2 while still in the sitting position.

While sliding down, the play participant can observe the river-like flow of the liquid through the upper member 9 and the upper oblique member 3, and can imagine himself or herself to be walking or sliding through a stream or in a waterfall over bare rocks. In particular for younger children such as preschoolers this will be a new sensation that they have not experienced so far, and will therefore double the fun.

Also, the stream of liquid is generated inside the hollows of the first and second play structure 2 and 8, which are hollow, so that the play participant will not get wet during play, which means that play is possible throughout the year and not only in summer.

Also, with the play facility 1 of this example, there is no risk of the liquid leaking to the outside, and it is possible to set up the play facility in an indoor children's area or the like without taking any special measures against leakages.

The foregoing was an explanation of an embodiment of the present invention, but there is no limitation to the specific configurations that can be adopted for the present invention.

Figure 4:
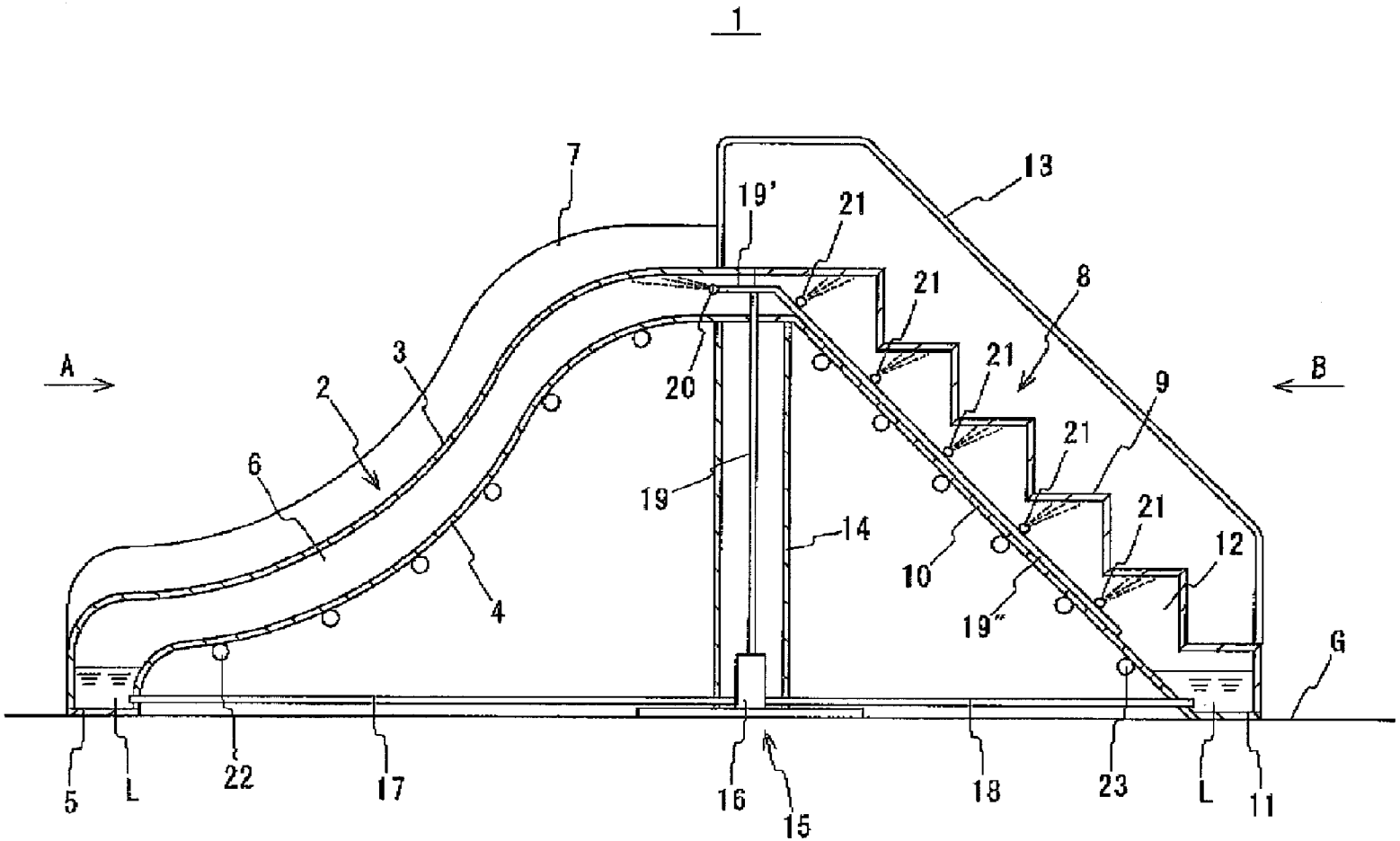
FIG. 4 is a lateral cross-sectional view of a play facility according to another embodiment of the present invention.

For example, in the foregoing example, the liquid spouting nozzles 20 and 21 are arranged near the upper end within the hollow portion of the first and second play structures 2 and 8, but there is no limitation to this, and it is also possible to draw out the branched second water supply duct 19" obliquely downward along the upper side of the lower member 10 and connect a plurality of liquid spouting nozzles 21 at predetermined spacings to this water supply duct 19", as shown in FIG. 4.

With this configuration, a flow of liquid can be formed without interruption along the entire rear face of the upper member 9, which is particularly effective in the case of the stair-shaped upper member 9.

Figure 5:
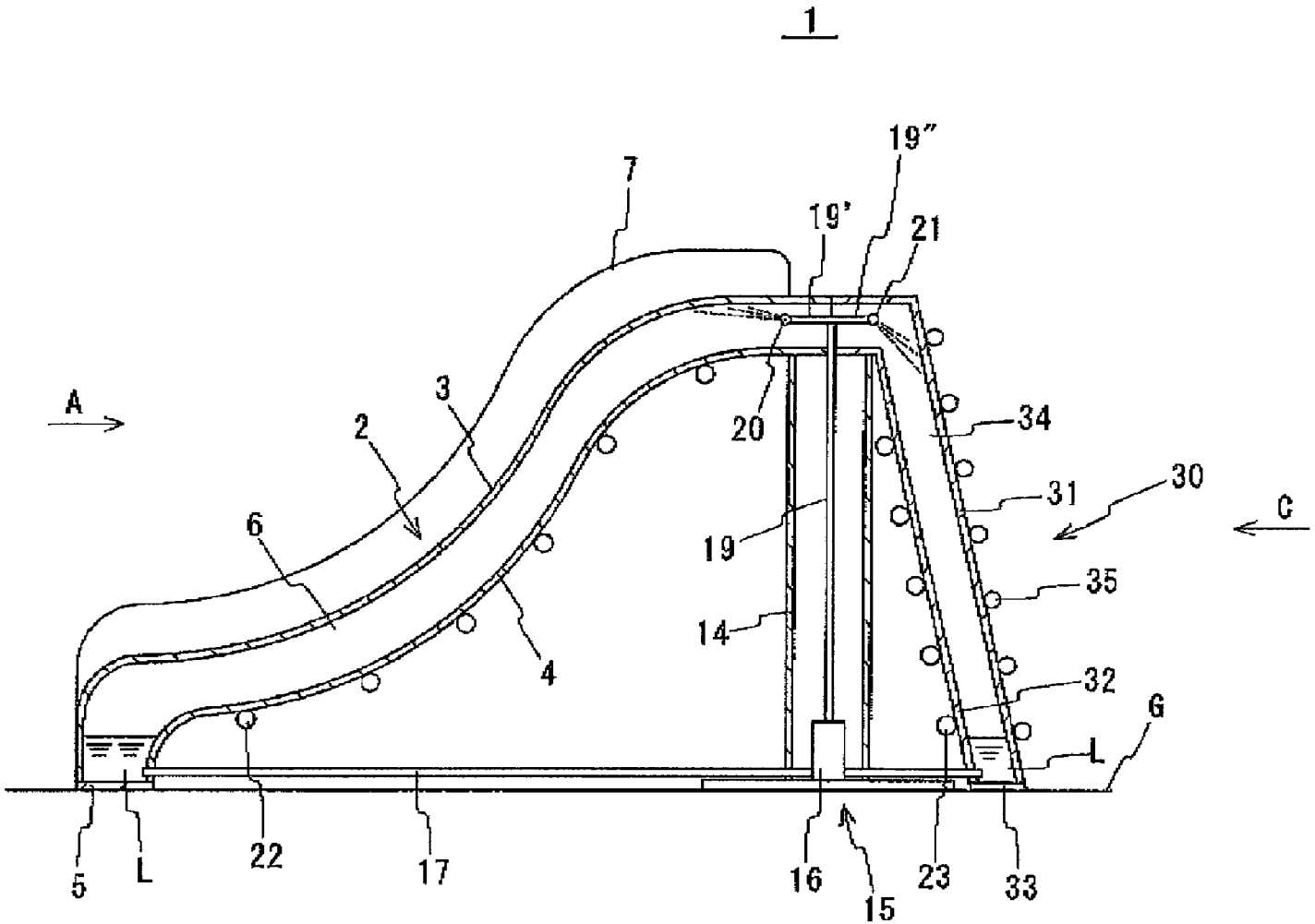
FIG. 5 is a lateral cross-sectional view of a play facility according to yet another embodiment of the present invention.
Figure 6:
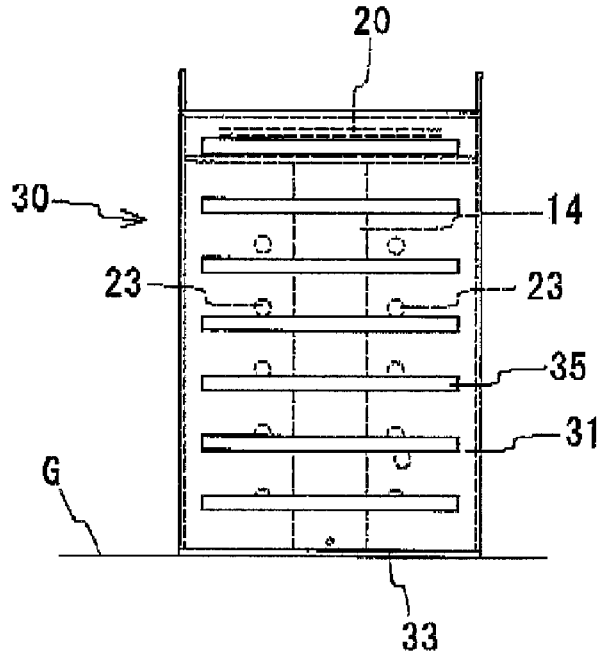
FIG. 6 is a rear view of the play facility in FIG. 5, taken from the direction of arrow C.

The structure of the first and the second play structures 2 and 8 may also be as shown in FIGS. 5 and 6, which show a modified example of the second play structure 8 shown in FIG. 1. FIG. 6 is a rear view of the play facility in FIG. 5, taken from the direction of arrow C.

As shown in FIGS. 5 and 6, the second play structure 30 shown in the figures is provided with an airtight hollow structure made of an upper oblique member 31, a lower oblique member 32, a bottom member 33, and two side members 34. The upper oblique member 31 and the lower oblique member 32 are arranged obliquely in parallel at a predetermined spacing. The bottom member 33 is fixed to the lower ends of the upper oblique member 31 and the lower oblique member 32. The two side members 34 are fixed to the two lateral ends of the upper oblique member 31 and the lower oblique member 32, respectively. Also, a plurality of rod-shaped (log-shaped) protrusions 35 are fixed in a ladder-like manner to the surface (play surface) of the upper oblique member 31.

Thus, the play participant can climb up while placing hands and feet on the rod-shaped protrusions 35, and can experience a sensation as if rock-climbing in a waterfall flowing along a cliff.

Figure 7:
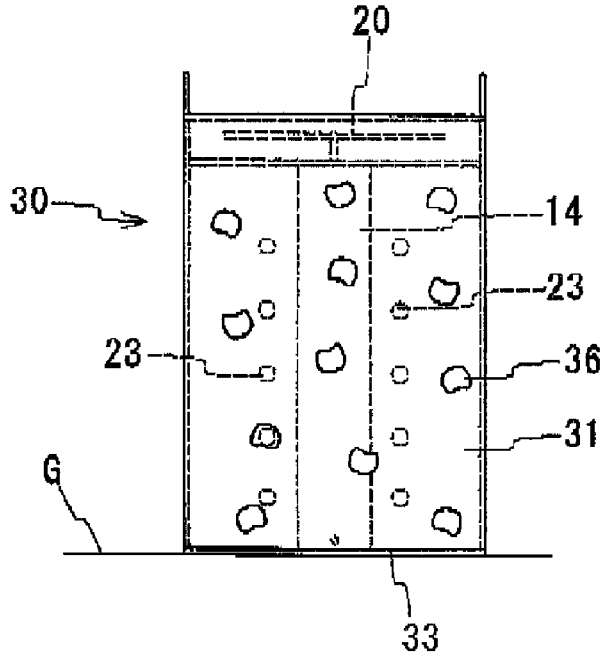
FIG. 7 is a rear view of a play facility according to yet another embodiment of the present invention, taken from the same direction as FIG. 6.

Alternatively, it is also possible to affix protrusions 36 shaped like small rocks in an irregular pattern, as shown in FIG. 7, instead of the rod-shaped protrusions 35. Also in this case, the play participant can climb up while placing hands and feet on the small rock-shaped protrusions 36, and can experience a sensation as if rock-climbing in a waterfall flowing along a cliff.

Furthermore, there is no particular limitation to the shape of the illumination lamps 22 and 23, and it is also possible to make them waterproof and place them inside the hollow portion of the first and second play structures 2 and 8.

Figure 8:
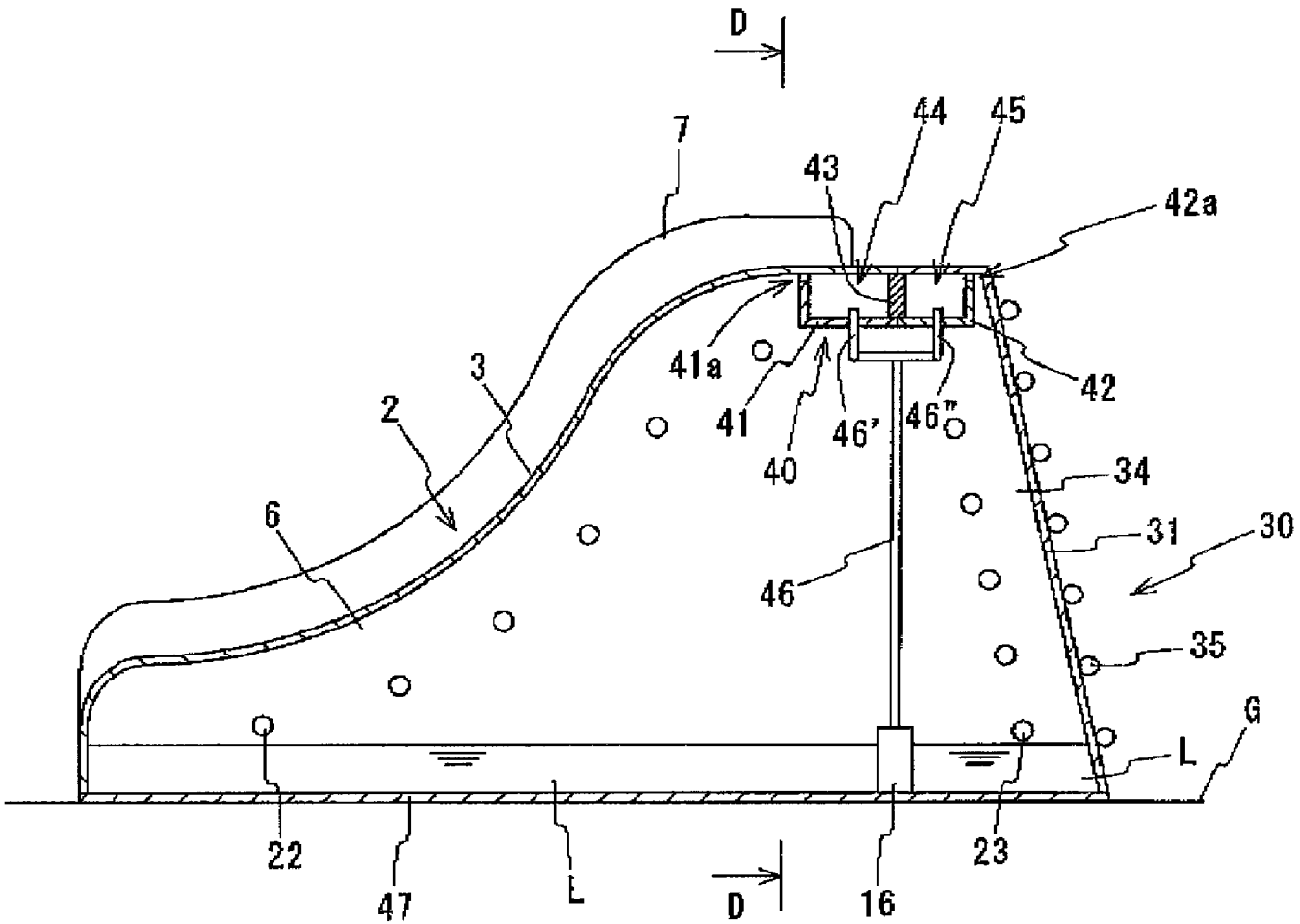
FIG. 8 is a lateral cross-sectional view of a play facility according to a further embodiment of the present invention.
Figure 9:
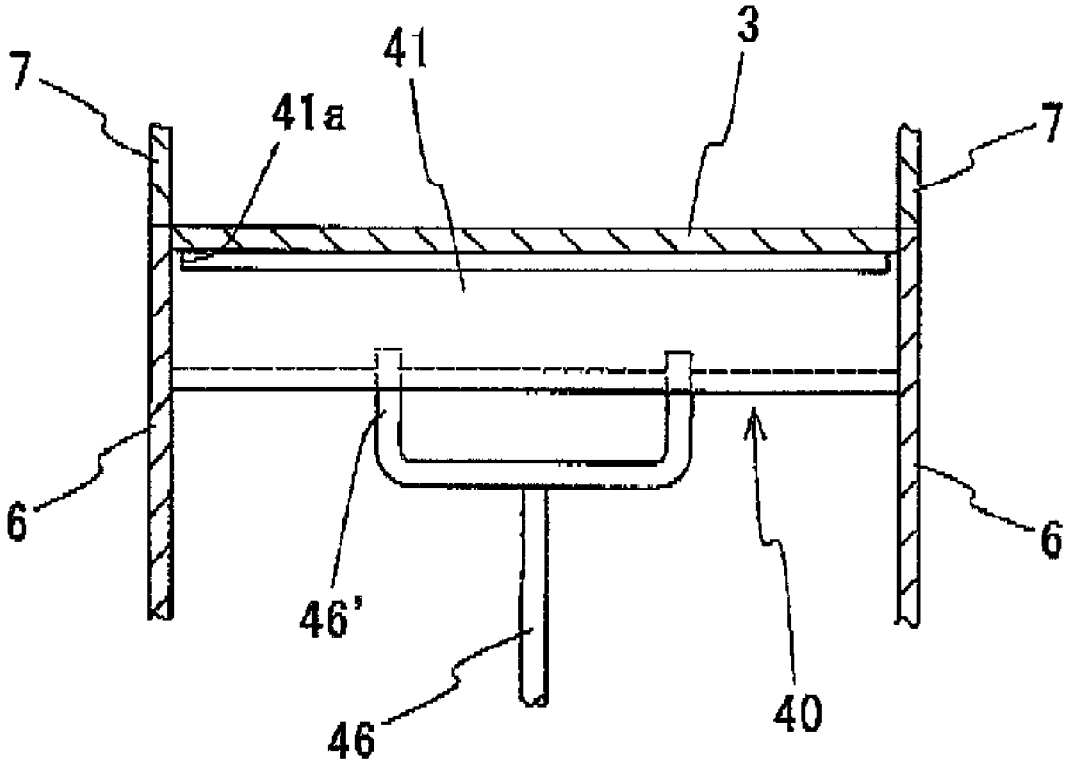
FIG. 9 is a cross-sectional view taken in arrow direction along the line D-D in FIG. 8.

Also, as shown in FIGS. 8 and 9, a configuration without the lower oblique members 4, 32, the support pillar 14 and the water intake duct 17 is also possible, in which a liquid spouting portion 40 is provided instead of the liquid spouting nozzles 20 and 21, a water supply duct 46 is provided instead of the water supply duct 19, and a bottom member 47 is provided instead of the bottom members 5 and 33. It should be noted that FIG. 8 is a lateral cross-sectional view showing a play facility according to this alternative embodiment of the present invention, and FIG. 9 is a cross-sectional view taken in arrow direction along the line D-D in FIG. 8.

The first play structure 2 and the second play structure 30 are configured so that the upper oblique members 3 and 31, the side members 6 and 34, and the bottom member 47 form an internally connected hollow and airtight space, and a predetermined amount of the liquid L is collected at the bottom thereof. Moreover, the illumination lamps 22 and 23 are supported by the side members 6 and 34, which ore covered by cover members as appropriate.

The liquid spouting portion 40 is arranged near the portion joining the first play structure 2 and the second play structure 30 together. The liquid spouting portion 40 is made of an L-shaped first spouting member 41, an L-shaped second spouting member 42, and a partitioning member 43. The L-shaped first spouting member 41 is fixed to the lower face of the upper oblique member 3 and is supported between the two side members 34. The second spouting member 42 is affixed to the lower face of the upper oblique member 31, is supported between the two side members 6, and its one end is connected to one end of the first spouting member 41. The partitioning member 43 is disposed between the lower face of the ends where the upper oblique members 3 and 31 are joined together and the upper face of the ends of the spouting members 41 and 42. The partitioning member 43 partitions the space formed by the spouting members 41 and 42, the oblique members 3 and 31 and the side members 6 and 34 into two spaces (a first space 44 and a second space 45).

On the other sides of the spouting members 41 and 42 slit-shaped cutouts 41*a* and 42*a* are formed along the width direction of the play structures 2 and 30. Moreover, one end of the water supply duct 46 is connected to the pump 16, and the other end of the water supply duct 46 is branched into two ducts 46' and 46". The front end of one duct 46' connected through the first spouting member 41 to the first space 44, and the front end of the other duct 46" is connected through the second spouting member 42 to the second space 45.

With this liquid spouting portion 40, the liquid L is supplied from the pump 16 through the water supply duct 46 into the spaces 44 and 55, and when the pressure on the liquid L in these spaces 44 and 45 increases, the liquid L is spouted from the cutouts 41*a* and 42*a* of the liquid members 41 and 42 against the rear faces of the upper oblique members 3 and 31.

Consequently, also with this configuration of the play facility, it is possible to attain the above-described effects. Moreover, since the lower oblique members 4 and 32, the support pillar 14 and the water supply duct 17 have been omitted, the configuration of the facility can be simplified.

Thus, the play facility according to the present invention can be safely used by preschoolers, and can be set up indoors without particular difficulties.

Only selected embodiments have been chosen to illustrate the present invention. To those skilled in the art, however, it will be apparent from the foregoing disclosure that various changes and modifications can be made herein without departing from the scope of the invention as defined in the appended claims. Furthermore, the foregoing description of the embodiments according to the present invention is provided for illustration only, and not for limiting the invention as defined by the appended claims and their equivalents.

What is claimed is:

1. A play facility comprising:

a hollow play structure having a play surface on which participants can engage in play, the play surface being a vertical surface, an oblique surface, or a stair-shaped surface, and a member constituting at least the play surface being made of a transparent material;

a liquid spouting means for spouting a pressurized liquid against a surface on an inner side of the transparent member, the liquid spouting means being disposed at an upper position within the hollow portion of the play structure; and a liquid supply means for pressurizing liquid collected in a bottom region inside the hollow portion of the play structure and supplying the pressurized liquid to the spouting means.

2. The play facility according to claim 1, wherein the play surface of the play structure is an oblique surface for enabling play participants to slide down the play surface.

3. The play facility according to claim 1, wherein the play surface of the play structure is a vertical surface or an oblique surface, and a plurality of protrusions are affixed on the play surface.

4. The play facility according to claim 1, wherein a plurality of said liquid spouting means are lined up at a predetermined spacing from an upper position to a lower position within the hollow portion of the display structure.

5. The play facility according to claim 1, further comprising an illumination means for illuminating the inside of the hollow bottom portion of the play structure, wherein light illuminating the inside of the hollow portion passes through the transparent member and is visible from outside.

6. The play facility according to claim 2, further comprising an illumination means for illuminating the inside of the hollow bottom portion of the play structure, wherein light illuminating the inside of the hollow portion passes through the transparent member and is visible from outside.

7. The play facility according to claim 3, further comprising an illumination means for illuminating the inside of the hollow bottom portion of the play structure, wherein light illuminating the inside of the hollow portion passes through the transparent member and is visible from outside.

8. The play facility according to claim 4, further comprising an illumination means for illuminating the inside of the hollow bottom portion of the play structure, wherein light illuminating the inside of the hollow portion passes through the transparent member and is visible from outside.

9. A play facility comprising:

a hollow play structure having a play surface on which participants can engage in play, the play surface being a vertical surface, an oblique surface, or a stair-shaped surface, the play surface being formed of a transparent material;

a liquid spouting nozzle to spout a pressurized liquid against a surface on an inner side of the transparent material, the liquid spouting nozzle being disposed at an upper position within the hollow portion of the play structure; and a pump to pressurize liquid collected in a bottom region inside the hollow portion of the play structure and to supply the pressurized liquid to the spouting nozzle.

* * * * *